US005674364A

United States Patent [19]

Pitkäjärvi

[11] Patent Number: 5,674,364

[45] Date of Patent: Oct. 7, 1997

[54] METHOD AND DEVICE IN THE REGULATION OF A HEADBOX

[75] Inventor: Kari Pitkäjärvi, Jyväskylä , Finland

[73] Assignee: Valmet Paper Machinery, Inc., Helsinki, Finland

[21] Appl. No.: 269,565

[22] Filed: Jul. 1, 1994

[30] Foreign Application Priority Data

Jul. 1, 1993 [FI] Finland ..... 933028

[51] Int. Cl.[6] ..... D21F 1/04

[52] U.S. Cl. ..... 162/216; 162/336; 162/343; 162/338

[58] Field of Search ..... 162/212, 216, 162/259, 336, 338, 343; 141/18; 57/142

[56] References Cited

U.S. PATENT DOCUMENTS

| | | | |
|---|---|---|---|
| 3,640,063 | 2/1972 | Schmid et al. | 57/140 |
| 4,146,425 | 3/1979 | Gutzeit | 162/252 |
| 4,225,386 | 9/1980 | Edblom et al. | 162/343 |
| 4,349,414 | 9/1982 | Stenberg | 162/123 |
| 4,384,922 | 5/1983 | Stotz | 162/259 |
| 4,414,062 | 11/1983 | Kirjavainen | 162/336 |
| 4,637,439 | 1/1987 | Jeans | 141/18 |
| 4,804,441 | 2/1989 | Lyytinen | 162/212 |
| 4,909,904 | 3/1990 | Kinzler | 162/343 |
| 5,022,965 | 6/1991 | Pitkajarvi | 162/192 |
| 5,092,962 | 3/1992 | Koski | 162/359 |
| 5,316,383 | 5/1994 | Begemann | 366/160 |

FOREIGN PATENT DOCUMENTS

| | | |
|---|---|---|
| 90260 | 6/1989 | Finland . |
| 2058594 | 5/1971 | France . |
| 3741603 | 6/1989 | Germany . |
| 1318727 | 5/1973 | United Kingdom . |

*Primary Examiner*—David L. Lacey
*Assistant Examiner*—Calvin Padgett
*Attorney, Agent, or Firm*—Steinberg, Raskin & Davidson, P.C.

[57] ABSTRACT

A method and device in the regulation of the headbox of a paper machine/board machine, in which additional flows are introduced into the pulp suspension at different points across the width of the headbox. The concentration of the additional flows is different than the average concentration of the pulp suspension. The additional flows are introduced through additional-flow pipes to the vicinity of inlet openings of turbulence tubes of a turbulence generator. The grammage profile of the web in the direction of width of the web is regulated in the headbox by adjusting the distance of the end of the additional-flow pipe/pipes from the turbulence generator, whereby the amount of the additional flow entering into the additional-flow pipes and, at the same time, the amount of the pulp suspension flow are regulated.

20 Claims, 8 Drawing Sheets

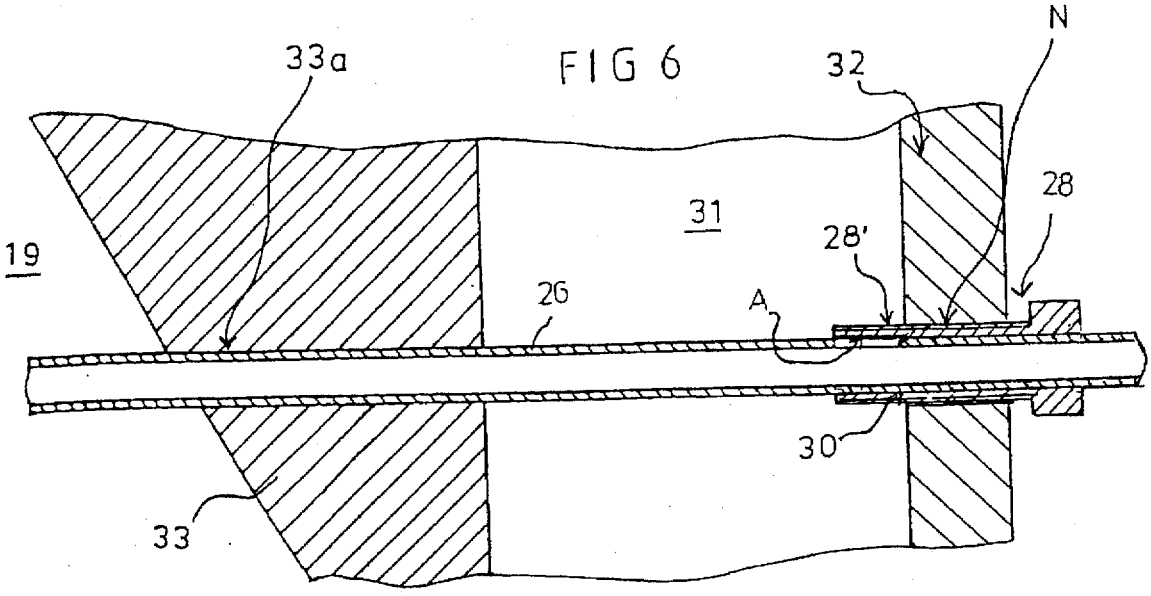
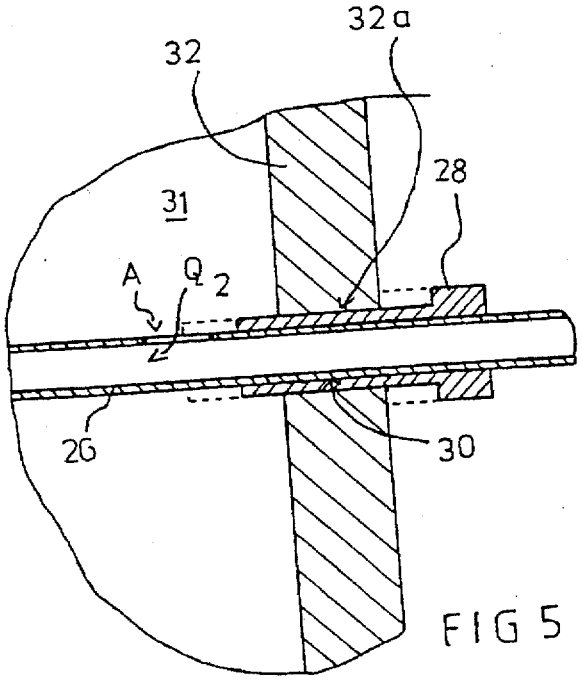
FIG 5

METHOD AND DEVICE IN THE REGULATION OF A HEADBOX

BACKGROUND OF THE INVENTION

The present invention relates to a method and device in the regulation of the headbox of a paper/board machine.

As is known from the prior art, the discharge flow of a pulp suspension out of the headbox should have a uniform velocity in the transverse direction of the paper machine. A transverse flow produces distortion of the fiber orientation which affects the quality factors of the paper produced, such as anisotropy of strength and stretch. The level and variation of anisotropy in the transverse direction also affect the printing properties of the paper. In particular, it is an important requirement that the main axes of the directional distribution, i.e. orientation, of the fiber mesh in the paper coincide with the directions of the main axes of the paper and that the orientation is symmetric in relation to these axes.

At the edges of the pulp-flow duct in the headbox, a smaller amount of pulp flows. This edge effect produces a very strong linear distortion in the fiber-orientation profile. Profile faults in the turbulence generator of the headbox usually produce a non-linear distortion in the fiber-orientation profile inside the lateral areas of the flow ducts.

Attempts have been made to compensate for an unevenness of the grammage profile arising from the drying-shrinkage of paper by means of a crown formation of the slice, so that the slice is thicker in the middle of the pulp jet. However, it is a phenomenon in the manufacture of paper that when the paper web is dried, it shrinks in the middle area of the web to a lower extent than in the lateral areas. The shrinkage is typically in the middle of the web about 4% and in the lateral areas of the web from about 5% to about 6%. This shrinkage profile produces a corresponding change in the transverse grammage profile of the web. As a result of the shrinkage, the dry grammage profile of a web whose transverse grammage profile was uniform after the press is changed during the drying so that, in both of the lateral areas of the web, the grammage is slightly higher than in the middle area. As known from the prior art, the grammage profile has been regulated by means of the profile bar so that the profile bar of the headbox is kept more open in the middle area of the headbox than in the lateral areas of the headbox. By means of this arrangement, the pulp suspension is forced to move towards the middle area of the web. This circumstance further affects the alignment of the fiber orientation.

It is desired that the main axes of the directional distribution, i.e. orientation, of the fiber mesh should coincide with the directions of the main axes of the paper, and the orientation should be symmetric in relation to these axes. In the regulation of the profile bar, a change in the orientation is produced as the pulp suspension flow receives components in the transverse direction.

Regulation of the lip of the headbox also produces a change in the transverse flows of the pulp jet even though the objective of the regulation is exclusively to affect the grammage profile, i.e. the thickness profile of the pulp suspension layer that is fed. Thus, the transverse flows have a direct relationship with the distribution of the fiber orientation.

From the prior art, devices are known which attempt to regulate the fiber orientation, and other separate devices are known separately by whose means attempts are made to regulate the grammage profile of the web. However, when the grammage profile is regulated in a prior art device by means of the profile bar, the fiber orientation in the web is unavoidably also affected at the same time.

From the prior art, a method is known in the headbox of the paper machine to control the distortion of the fiber orientation in the paper web. In the method, medium flows are passed into lateral passages placed at the level of the turbulence generator of the headbox, and, by regulating the magnitudes and the mutual proportions of these flows, the transverse flows of the pulp suspension are affected, and thereby the distortion of the fiber orientation is regulated. By means of the flows introduced into the lateral passages, a transverse flow velocity is produced which compensates for the distortion of the fiber orientation.

In addition, from the assignee's Finnish Patent Application No. 884408 (corresponding to the assignee's U.S. Pat. No. 5,022,965, the specification of which is hereby incorporated by reference herein) of earlier date, a method is known in the headbox of a paper machine for controlling the distribution of the fiber orientation of the paper web in the transverse direction of the machine. In this method, the transverse velocity component of the discharge jet is regulated by appropriately aligning the turbulence tube of the turbulence generator.

By means of the above mentioned prior art methods for controlling the fiber orientation in the paper web, it is usually possible to control only the linear distortion profiles. The prior art methods are suitable for the control of the fiber orientation, but, when they are used, even a large non-linear residual fault remains in comparison with an even distribution of the orientation. The prior art methods are well suitable for basic regulation of the distortion of the orientation. However, by means of the prior art methods, it is not possible to regulate individual faults which may occur in the orientation in the middle area of the web and which arise, e.g., from defects in the pipe system of the turbulence generator.

A number of methods are also known for the regulation of the profile bar. In these methods, while the grammage profile is measured, the position of the profile bar in the headbox of the paper machine is changed such that by means of the profile bar, the thickness of the pulp suspension discharged onto the wire, and thus the grammage of the paper web, are affected. In the manner described above, this regulation, however, produces faults in the orientation because by means of the regulation, the flow is throttled on one hand, whereby components of transverse velocity are produced in the flow.

OBJECTS AND SUMMARY OF THE INVENTION

Accordingly, it is an object of the present invention to provide novel solutions for the problems discussed above.

It is also an object of the present invention to provide a new and improved method and device by whose means it is possible to control both the fiber-orientation profiles and the grammage—orientation profiles of the paper web across the width of the paper web.

In the invention, the grammage profile is affected by adding a component flow, whose concentration differs from the average concentration of the pulp flow, into the pulp flow. Thus, into the main pulp flow, it is possible to add, for example, water alone, i.e. 0-water, or a diluted pulp suspension, whose concentration differs from the concentration of the main pulp flow. In the prior art devices, the grammage profile was changed by acting upon the thickness of the discharge jet by means of the profile bar. In the invention, however, a profile bar is not necessarily needed.

In accordance with the invention, the headbox comprises separate zones across the width of the headbox, into which zones it is possible to feed an additional flow whose consistency has been regulated to the desired level. By means of the additional flows, a fault in the grammage profile occurring in a certain width position of the web can be corrected. Thus, into a certain position of width in the headbox, it is possible to introduce a pulp suspension thicker than average or a pulp suspension more dilute than average, such as 0-water, depending on the measured grammage-profile error, so as to correct the error. However, it is important in the regulation of the grammage profile that the flow quantity of the sum flow (the additional flow plus a flow of the average pulp suspension) is kept substantially invariable. As a result, in the regulation of the consistency, changes are not produced in the overall flow velocity profile of the pulp suspension. Thus, by means of the additional flow in the regulation of consistency, only the consistency of the pulp suspension at a certain position of width is affected and therefore, by means of the additional flow, any faults occurring in the grammage profile are corrected.

In the method in accordance with the invention, the fiber orientation is regulated by regulating the flow quantity of a plurality of additional flows across the width of the headbox. Thus, when it is desired to correct the fiber-orientation profile, the flow-velocity profile coming out of the system of tubes of the turbulence generator is affected locally in the direction of width of the web, and the flow quantity is increased or, if necessary, reduced locally at a certain position of width of the web. In this manner, it is possible to act upon any local faults occurring in the fiber orientation without affecting the fiber orientation in the other areas of the web.

The headbox in accordance with the invention comprises, proceeding in the flow direction of the pulp suspension, an inlet header, a distribution manifold and an equalizing chamber, a turbulence generator, and a discharge duct. The discharge duct is defined by a stationary lower-lip wall and by an upper-lip wall pivoting around a horizontal articulated joint. The upper-lip beam and, along with it, the upper-lip wall are arranged to be pivoted around the articulated joint by means of a screw gear. The profile bar that defines the slice from above is regulated by means of a series of adjusting spindles and a series of adjusting gears. However, in accordance with the invention, a separate profile bar is not always required.

In accordance with the invention, the headbox comprises ducts, preferably pipes, for the introduction of the additional flow. The ducts or pipes are arranged so that their ends are placed at a distance from the inlet openings of the turbulence tubes in the turbulence generator. The pipes are arranged to be displaceable, and through them an additional flow is introduced having a concentration differing from the average concentration of the pulp suspension. Advantageously, the additional flow is merely water free from pulp fibers, i.e. so-called 0-water. In accordance with the invention, the pipes are passed through the end wall in the intermediate chamber, and, at one end, they comprise an opening in the mantle face of the pipe, which opening is opened into the additional-flow distribution chamber for the additional flow. Thus, the additional flow is introduced from a separate distribution chamber into the pipes and through them into connection with the inlet end of the turbulence generator. By regulating the position of the pipes in relation to the end of the turbulence generator, the throttle of the flow of the pulp suspension in the intermediate chamber from the intermediate chamber into the tubes in the turbulence generator is also regulated.

In a preferred embodiment of the invention, there may be several pipes in the vertical direction, and in the direction of width the pipes are placed with a certain spacing across the entire width of the headbox. Thus, an additional flow is passed into a certain and desired position of width of the headbox into a certain zone so as to regulate the consistency of the pulp suspension locally. The additional flow and a regular pulp flow are combined to form a combined pulp suspension flow in the turbulence tube in the turbulence generator.

In the device in accordance with the invention, the end of the set of ducts for the additional flow is connected with an actuator, which displaces the additional-flow pipe toward or away from the turbulence generator. By means of the actuator, it is possible to move either one pipe or a separate vertical group of pipes. In a corresponding manner, the pipes may have been installed together as groups in the direction of width of the machine, in which case the movement of the pipes may take place under group control or by moving each pipe individually. The additional flow into the additional-flow pipe out of the additional-flow distribution chamber is regulated separately. For this regulation, there is a separate bushing, the additional flow pipe and a flow opening provided in its mantle face are displaceable into different positions in relation to the bushing, whereby the covering of the opening is altered. The bushing is also arranged to be displaceable in the opening in the end wall of the additional-flow distribution chamber. The bushing surrounds the additional flow pipe.

Furthermore, in the method in accordance with the invention, the additional flows are introduced through additional-flow pipes to the vicinity of the inlet opening of the turbulence tube of the turbulence generator. The grammage profile of the web in the direction of width of the web is regulated by adjusting the distance of the end of the additional-flow pipe/pipes from the turbulence generator in the headbox of the paper machine such that the amount of the additional flow entering into the additional-flow pipe and, at the same time, the amount of the pulp suspension flow are affected. In this manner, the combined flow, as a sum flow into the turbulence generator, is regulated.

In addition, the headbox of a paper machine in accordance with the invention comprises additional-flow pipes arranged in different width positions across the width of the headbox. An additional flow is passed into the pulp suspension through these pipes. The concentration of this additional flow differs from the average concentration of the pulp suspension. The additional-flow pipes are arranged to be displaceable toward the turbulence tubes of the turbulence generator, and apart from the turbulence tubes by means of an actuator. In a preferred embodiment, the headbox includes a regulation device by whose means the additional flow into the additional-flow pipes is regulated.

In the following, the invention will be described in detail with reference to some exemplifying embodiments of the invention illustrated in the figures in the accompanying drawing, the invention being by no means strictly confined to the details of the embodiments.

BRIEF DESCRIPTION OF THE DRAWINGS

The following drawings are illustrative of embodiments of the invention and are not meant to limit the scope of the invention as encompassed by the claims.

FIG. 5 illustrates the regulation of the additional flow by means of a bushing.

FIG. 6 shows a second embodiment of the coupling between the bushing and the additional-flow pipe.

DETAILED DESCRIPTION OF THE INVENTION

Figure 1:
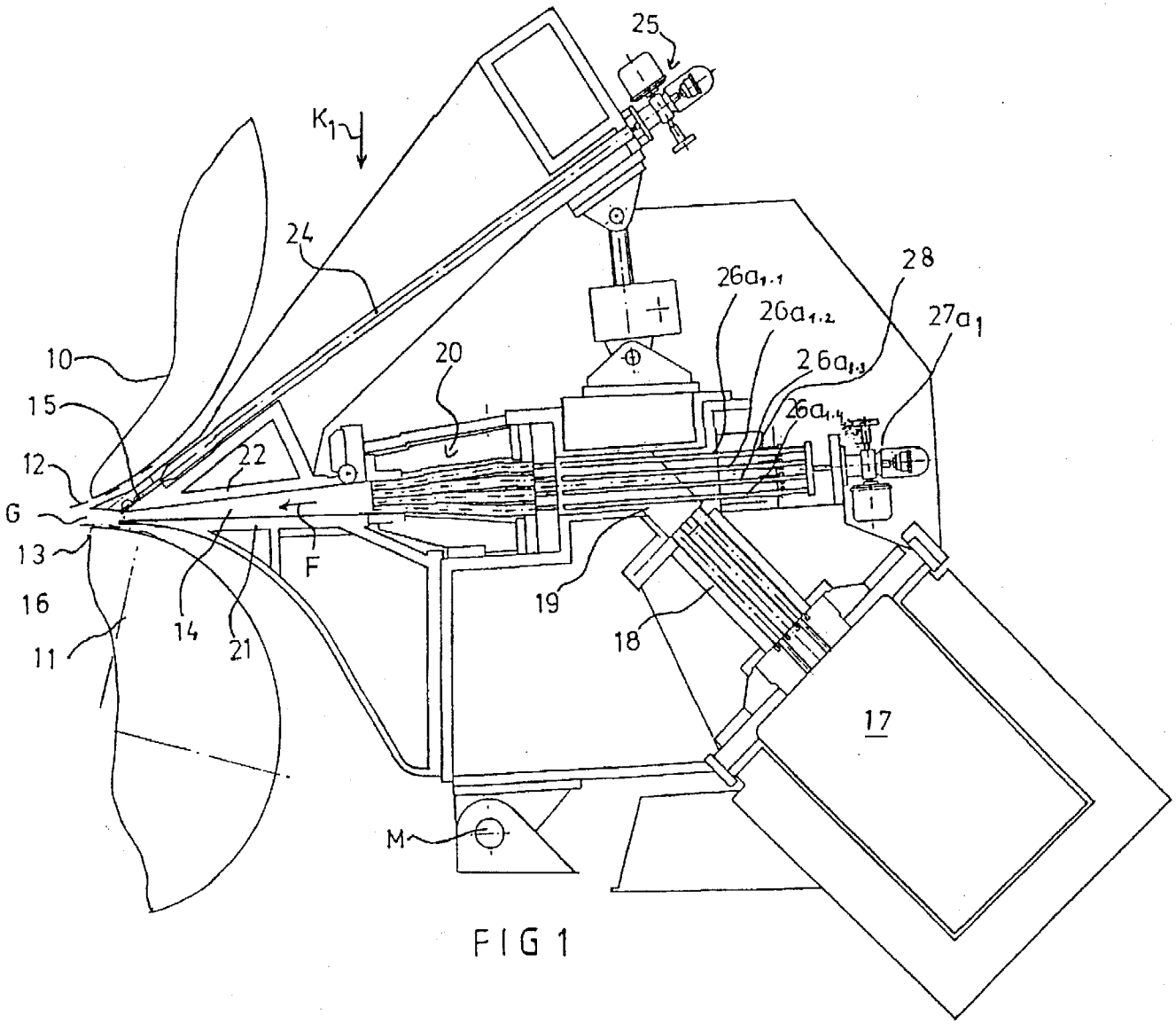
FIG. 1 is a vertical sectional view of a headbox of a paper machine in accordance with the invention.

Referring to the drawings wherein like reference numerals refer to the same elements, FIG. 1 shows the headbox in connection with a twin-wire former. The former includes a pair of breast rolls 10 and 11 and forming wires 12 and 13 that run over the breast rolls and define a forming gap G between them. Out of a discharge duct 14 of the headbox, a pulp suspension jet is fed through a slice 16 defined by a profile bar 15 into the forming gap G defined by the wires 12 and 13.

Proceeding in the flow direction F of the pulp suspension, the headbox comprises an inlet header 17, a distribution manifold 18, an intermediate chamber 19, a turbulence generator 20, and a discharge duct 14. The discharge duct 14 is defined by a stationary lower-lip wall 21 and by an upper-lip wall 22 that pivots around a horizontal articulated joint M. The upper-lip beam and, along with it, the upper-lip wall 22 are arranged to be pivoted by means of a screw gear 23 around the articulated joint M. The profile bar 15, which defines the slice from above, is regulated by means of a series of adjusting spindles 24 and by means of a series of adjusting gears 25.

Figure 2:
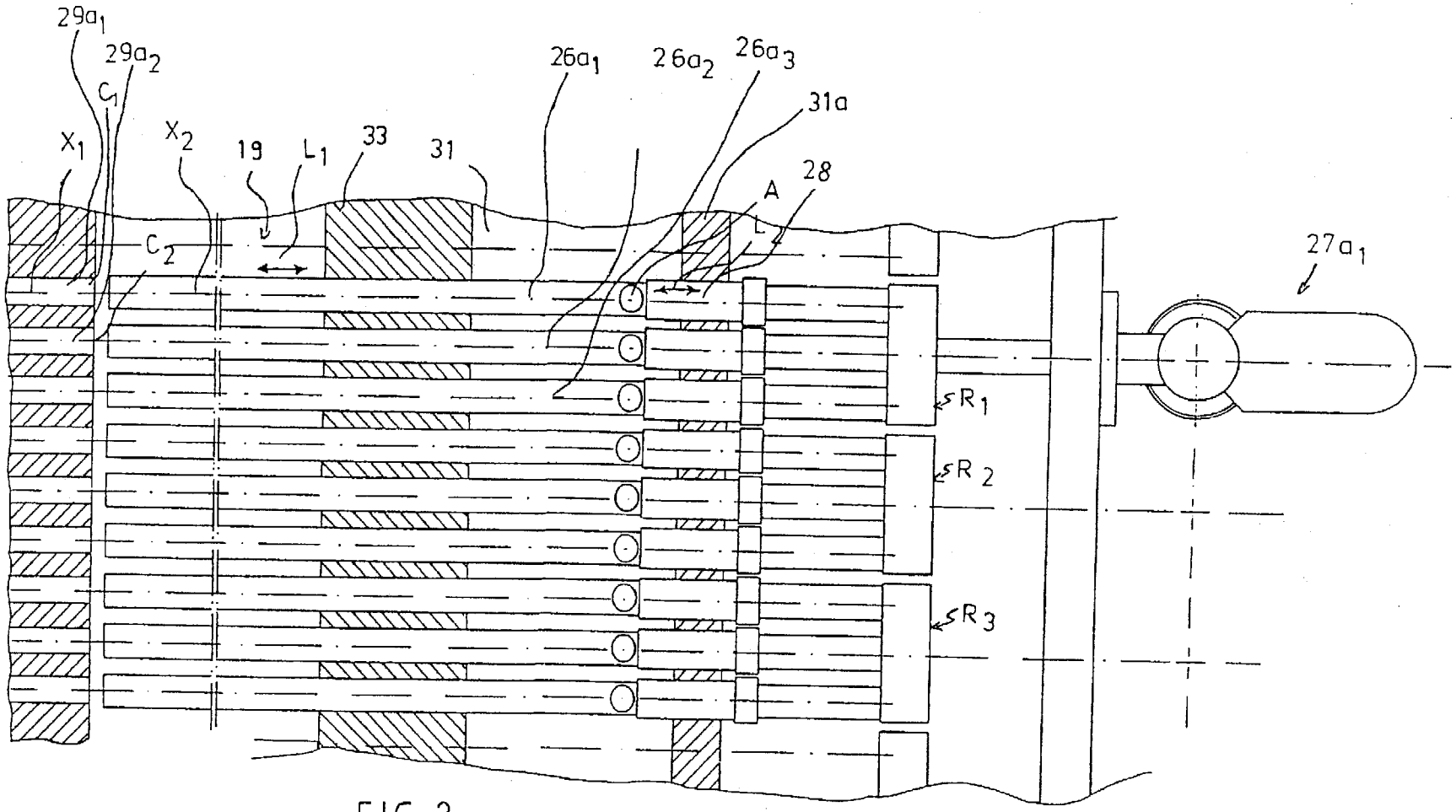
FIG. 2 shows the headbox as viewed in the direction of the arrow $K_1$ in FIG. 1.

As shown in FIG. 2, the headbox in accordance with the invention comprises a number of additional-flow duct means such as pipes $26a_1, 26a_2, \ldots$ arranged in the direction of width of the headbox, i.e., the transverse direction of the headbox. Preferably, when the longitudinal section of the headbox is examined, a number of additional-flow pipes $26a_{1.1}$, $26a_{1.2}$, $26a_{1.3}$; $26a_{2.1}$, $26a_{2.2}$, . . . , $26a_{3.1}$, $26a_{3.2}$, $26a_{3.n}$, . . . , $26a_{n.1}$, $26a_{n.2}$, . . . , $26a_{n.n}$ are arranged in a vertical direction, to thus form a matrix of pipes. The additional flow pipes carry a plurality of component subflows of the additional component flow $Q_2$.

As shown in FIG. 2, in the vertical direction, four additional-flow pipes $26a_{1.1}$, $26a_{1.2}$, $26a_{1.3}$, $26a_{1.4}$ are arranged in each position of width, i.e., in the transverse direction of the headbox. The regulation of four additional-flow pipes is arranged to take place as groups $R_1, R_2, \ldots$ An actuator $27a_1, 27a_2, \ldots$ is arranged to displace each group $R_1, R_2, \ldots$ at the same time in the longitudinal direction of the headbox (arrow $L_1$), viewed in the machine direction. Thus, the additional-flow pipes 26 in each group $R_1, R_2$ are displaced at the same time toward the turbulence generator 20. However, each of the groups $R_1, R_2 \ldots$ can also be brought further apart from the turbulence generator 20.

Each additional-flow pipe 26 comprises a regulation device 28, preferably a bushing, by whose means a component subflow of pulp and/or water in the additional component flow is regulated into the additional-flow pipe 26. Each additional-flow pipe 26 is opened at its end into the intermediate chamber 19.

FIG. 2 shows the headbox as viewed from above in the direction of the arrow $K_1$ in FIG. 1. In the headbox, in its different positions of width, a number of additional-flow pipes $26a_1, 26a_2 \ldots$ have been arranged so as to regulate the consistency of the pulp suspension, forming each of the component subflows, to the desired level at each position of width. As shown in FIG. 2, the additional-flow pipes $26a_1$, $26a_2 \ldots$ are placed in groups $R_1, R_2 \ldots$ of three pipes so that each group can be regulated by means of an actuator $27a_1, 27a_2$ of its own. The three pipes 26 in each group $R_1, R_2$ are thus displaced at the same time into the desired position in relation to respective inlet openings $C_1, C_2, \ldots$ of the turbulence tubes $29a_1, 29a_2, \ldots$ at the inlet end of the turbulence generator 20. The closer or nearer the pipes 26 in the group $R_1, R_2 \ldots$ are brought to the respective inlet openings $C_1, C_2, \ldots$ of the turbulence tubes $29a_1, 29a_2, \ldots$ in the turbulence generator 20, the more is the pulp suspension throttled that flows from the intermediate chamber 19 into the turbulence tubes $29a_1, 29a_2, \ldots$, i.e., the throttle is increased. In a corresponding manner, when the additional-flow pipes $26a_1, 26a_2, \ldots$ are brought further apart from the inlet openings, the throttle is reduced and thus the pulp suspension flow, or component flow, $Q_1$ from the intermediate chamber 19 into the turbulence tubes $29a_1, 29a_2 \ldots$ in the turbulence generator is increased. The consistency of the entire pulp suspension, including other component flows, is regulated by regulating the subflows of the additional component flow $Q_2$.

In the device in accordance with the invention, a bushing 28 can be displaced into different covering positions in relation to an inlet opening A for the additional component flow in the additional-flow pipe. Each bushing 28 is operationally connected with the rear wall of the additional-flow chamber 31 preferably by means of a threaded or press fitting N. When the additional-flow pipe 26 is displaced by means of the actuator 27, the bushing 28 remains in its position while there is a glide fitting between the bushing 28 and the additional-flow pipe 26. The area of the inlet opening of each of the additional component flows $Q_2$ across the width of the headbox changes so that the sum flow $Q_3$ ($=Q_1+Q_2$) remains invariable.

In a preferred embodiment, the inlet opening A is shaped so that the change in the consistency can be made linear. When the bushing 28 is displaced in relation to the rear wall of the additional-flow chamber, with a certain mixing ratio, it is possible to regulate the flow quantity of the sum flow $Q_3$ (the additional component flow added to an average component flow). When the additional-flow pipe 26 and the bushing 28 are shifted toward the turbulence tube, the flow quantity or rate of the total flow $Q_3$ is reduced. In a corresponding manner, when both the additional-flow pipe 26 and the bushing 28 are brought further apart from the turbulence tube of the turbulence generator 20, the flow quantity of the total flow $Q_3$ is increased.

Figure 3:
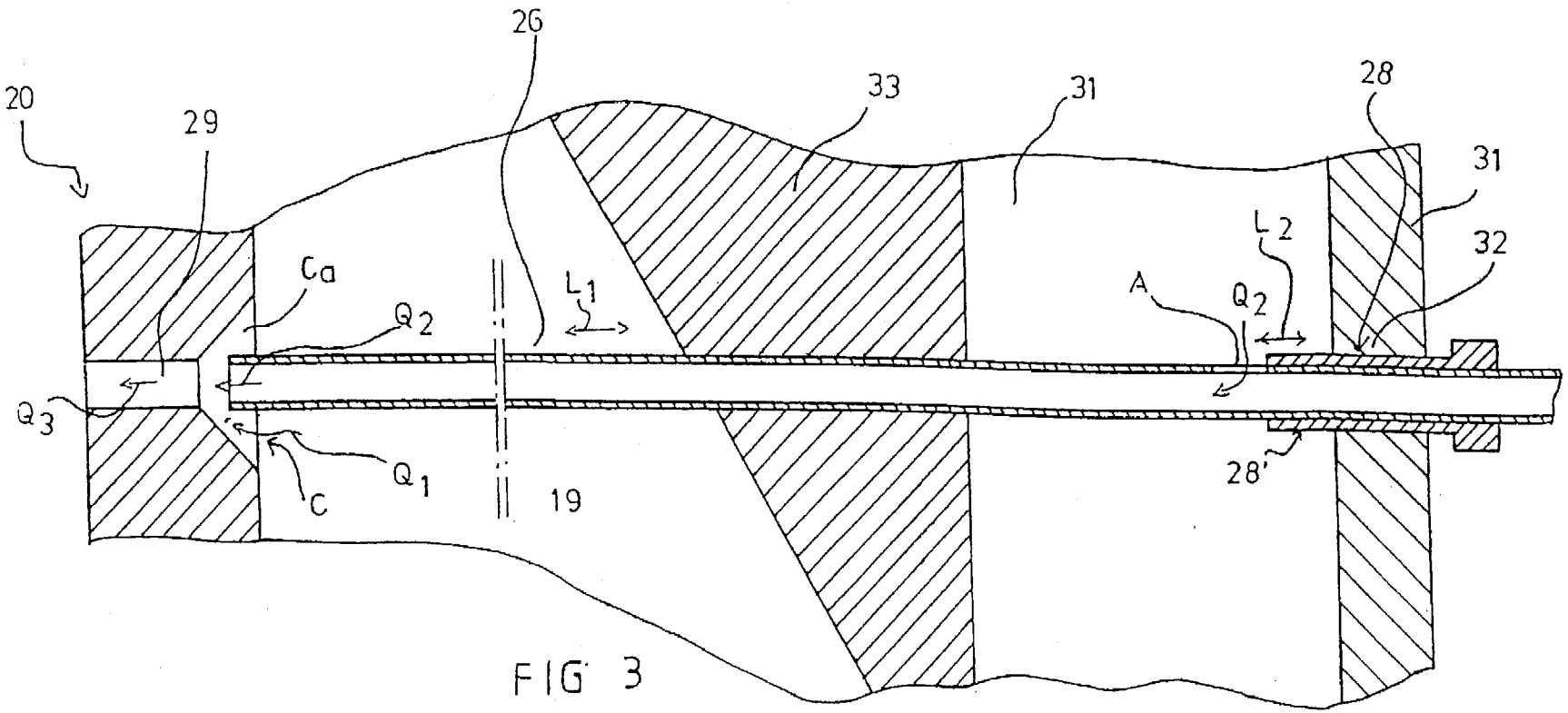
FIG. 3 is a separate illustration of the arrangement of an additional-flow pipe in connection with the headbox.

FIG. 3 shows the relative position of the additional-flow pipe 26 and an inlet pipe 29 of the turbulence generator 20 when the inlet pipe 29 of the turbulence generator 20 includes a conical inlet opening C having a conical portion $C_a$. The end of the additional-flow pipe 26 can be placed into the conical portion $C_a$.

Figure 4:
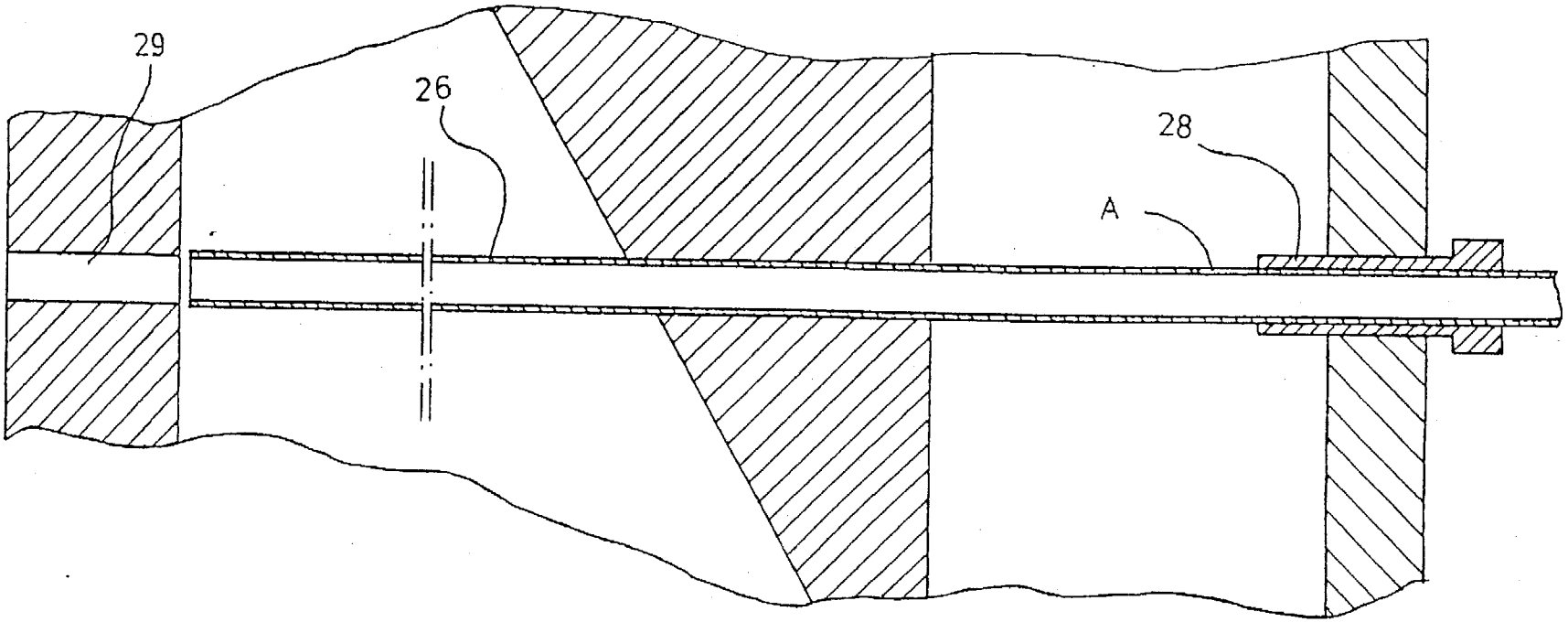
FIG. 4 shows a second end construction of the turbulence generator and an additional-flow pipe in connection with the construction.

FIG. 4 shows a second embodiment of the operational connection between the additional-flow pipe 26 in the headbox in accordance with the invention and the turbulence tube 29 in the turbulence generator. In this embodiment, the inlet opening C of the turbulence tube 29 comprises a straight, non-conical end portion. The operation of the regulation itself is similar both in the embodiment of FIG. 3 and in the embodiment of FIG. 4.

FIG. 5 shows two different regulation positions of the regulation bushing 28 in relation to the inlet opening A of the additional component flow $Q_2$ in the additional-flow pipe 26. As shown by the dashed lines, the bushing 28 has been made to glide on the additional-flow pipe 26 into a position that covers the inlet opening A of the additional component flow more fully. As shown by the non-dashed lines, the position of the bushing 28 is fully away from the inlet opening A, in which case the throttle of the additional component flow $Q_2$ is at the minimum.

FIG. 6 shows an embodiment in which the operational coupling between the regulation bushing 28 and the additional-flow pipe 26 is accomplished by means of a glide joint 30. Between an outer face 28' of the bushing 28 and a through opening 32*a* in an end wall 32 of a distribution chamber 31 for the additional-flow medium, there is preferably a threaded joint N. Between the intermediate chamber 19 and the distribution chamber 31 for the additional-flow medium, there is a common wall 33, through whose opening 33*a* the pipe 26 is passed with a glide fitting.

FIG. 6 shows the bushing 28 in a position in which the inlet opening A of the additional-flow pipe 26 is fully closed. By rotating the bushing 28, the portion of the inlet opening A which is exposed to the distribution chamber 31 is regulated.

Figure 7A:
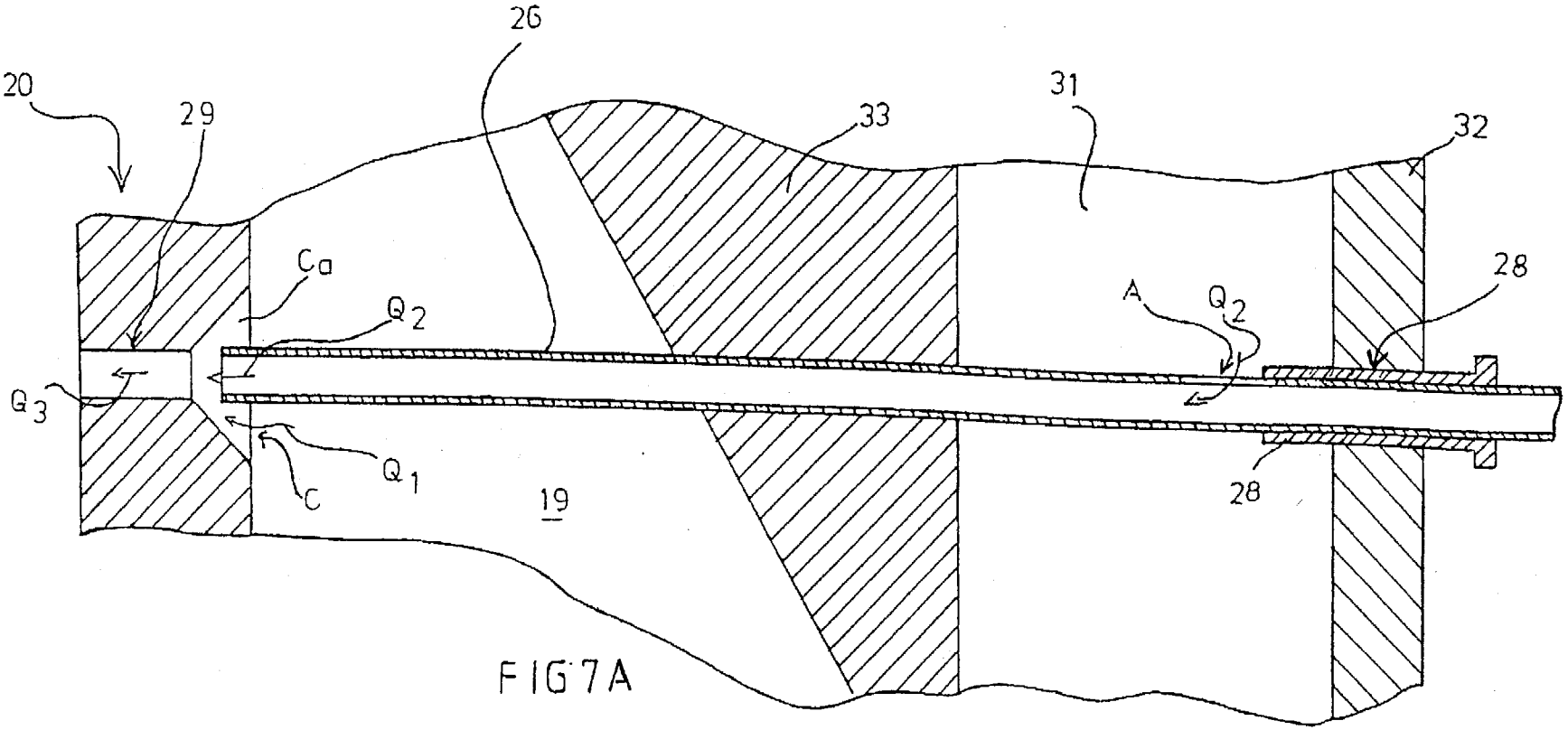
FIGS. 7A, 7B and 7C show different embodiments of the regulation.
Figure 7B:
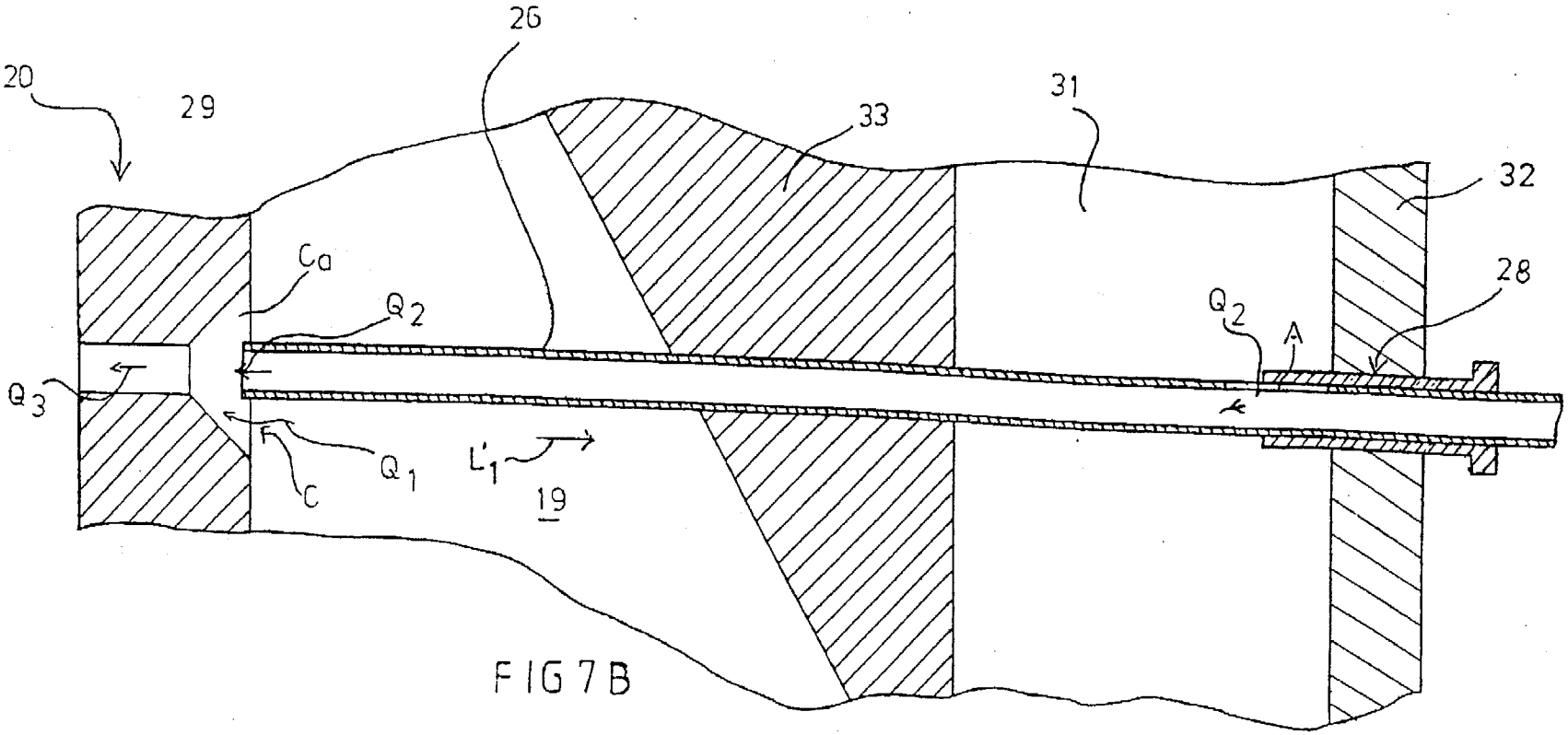
Figure 7C:
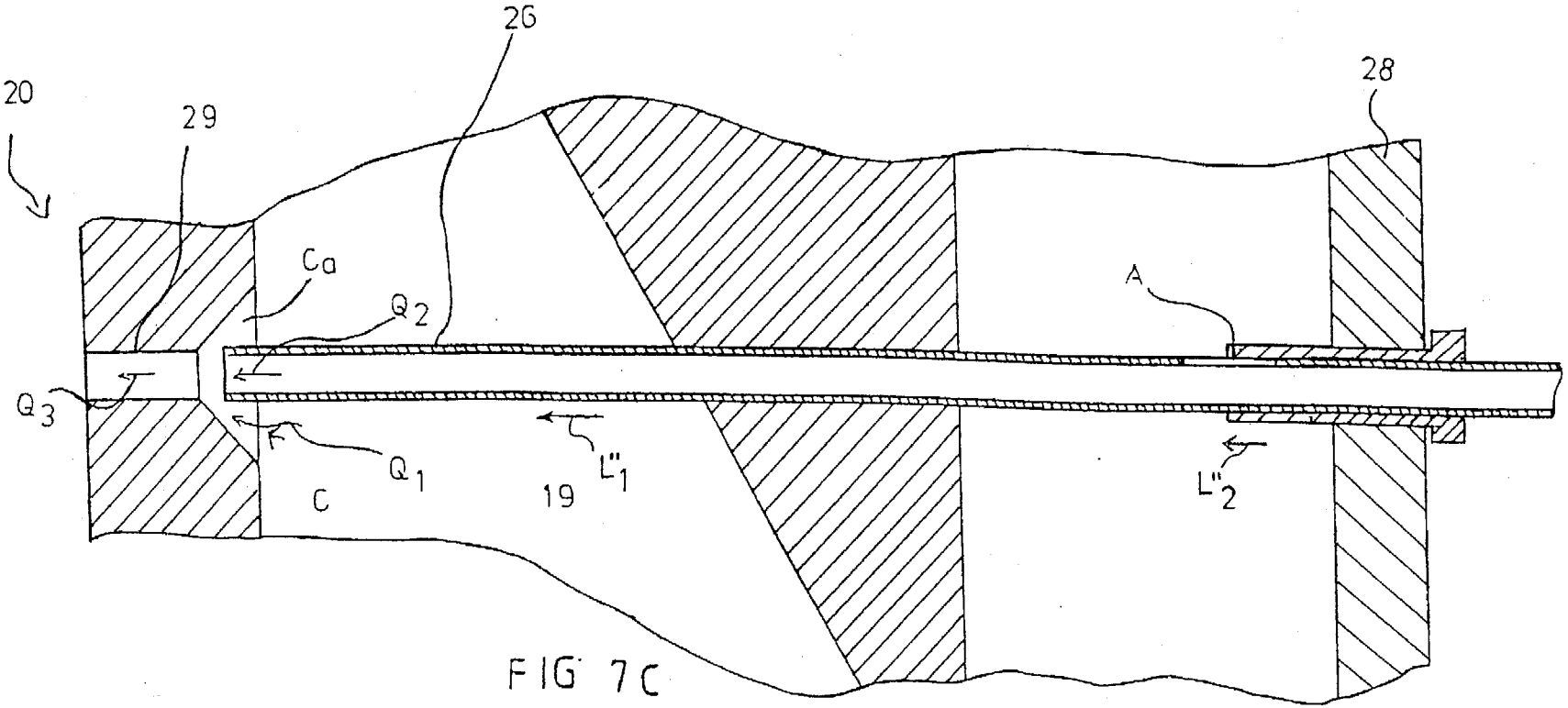

In the regulation devices shown in FIGS. 7A, 7B and 7C, the additional component flow $Q_2$ is preferably water.

FIG. 7A shows a first regulation position of the regulation achieved in the method and device in accordance with the invention, wherein the additional-flow pipe 26 is arranged at the vicinity of the inlet opening C of the turbulence tube 29 in the turbulence generator. The consistency of the flow $Q_3$ (=additional component flow $Q_1$+average component flow $Q_2$) is $D_1$.

FIG. 7B shows a regulation position in which the additional-flow pipe 26 has been shifted rearward while the bushing 28 remains in its place. Then, the throttle of each of the component subflows of the component flow $Q_2$ is increased and, correspondingly, the throttle of the component flow $Q_1$is reduced by a corresponding amount. The mixing ratio of the sum flow $Q_3$ ($=Q_1+Q_2$) is regulated continuously while the flow $Q_3$ remains at its invariable, constant quantity value. The movement of the additional-flow pipe 26 apart from the turbulence generator is illustrated by the arrow $L_1'$. The consistency of the flow $Q_3$ is adjusted to $D_2$.

FIG. 7C illustrates an embodiment of the regulation in which, with the regulated mixing ratio of FIG. 7B and with the consistency $D_2$, the flow quantity of the flow $Q_3$ is reduced. As shown in FIG. 7C, the additional-flow pipe 26 is placed (arrow $L_1''$) close to the mouth opening of the turbulence tube 29 in the turbulence generator. Then, the flow $Q_1$ is reduced and, to keep the mixing ratio at its regulated value $D_2$, the bushing 28 is shifted in the way shown by the arrow $L_2''$ into a position of increased covering in relation to the opening A of the additional-flow pipe 26.

If the flow quantity of the flow $Q_3$ is to be increased by means of the mixing ratio of FIG. 7B, the additional-flow pipe 26 is moved further apart from the end of the turbulence tube in the turbulence generator and, correspondingly, the throttle of the flow $Q_2$ is reduced by moving the bushing 28 in the same shifting direction, whereby the covering of the opening A is reduced.

The examples provided above are not meant to be exclusive. Many other variations of the present invention would be obvious to those skilled in the art, and are contemplated to be within the scope of the appended claims.

I claim:

1. A method for regulating a total pulp flow discharged from a headbox to form a web, said total headbox pulp flow being formed from a first component flow and a second component flow, said second component flow comprising a plurality of second component subflows introduced into said first component flow at different points in a direction transverse to a direction of flow of said first component flow, said headbox including a turbulence generator having turbulence tubes coupled to an outlet of said headbox, comprising the steps of:

passing said first component flow into said turbulence tubes, carrying each of said second component subflows through a respective one of a plurality of additional-flow pipes and out of a discharge end thereof aligned with an inlet opening of a respective one of said turbulence tubes, regulating an amount of each of said second component subflows being carried through said additional-flow pipes, and regulating grammage of the web in the direction transverse to the flow direction of said first component flow by adjusting the distance between the discharge end of each of said additional-flow pipes and the inlet opening of a respective one of said turbulence tubes aligned therewith to thereby regulate the amount of said second component subflows and said first component flow entering into said turbulence tubes, whereby a combined flow of said first and second component flows into said turbulence generator is regulated.

2. The method of claim 1, further comprising the steps of:

arranging a bushing around at least one of said additional-flow pipes, drawing a medium forming one of said second component subflows through an inlet opening of said at least one of said additional-flow pipes into said at least one of said additional-flow pipes, and displacing said at least one of said additional-flow pipes relative to said bushing to regulate the size of said inlet opening and thereby the amount of said second component subflows being drawn into and carried through said additional-flow pipes.

3. The method of claim 1, wherein the step of regulating the amount of said second component subflows being carried through said additional-flow pipes comprises the steps of:

arranging a bushing around each of said additional-flow pipes, drawing a medium forming one of said second component subflows into each of said additional-flow pipes through an inlet opening arranged in a mantle face of each of said additional-flow pipes, and regulating rates of flow of said first component flow and said second component subflows in said turbulence tubes by displacing each of said bushings relative to a respective one of said inlet openings in each of said additional-flow pipes to vary the quantity of said second component subflows passing through said additional-flow pipes.

4. The method of claim 1, wherein said second component subflows comprise water.

5. The method of claim 1, wherein said second component subflows comprise a pulp suspension having a concentration different than the average concentration of said first component flow.

6. The method of claim 1, further comprising the steps of:

grouping said additional-flow pipes in the same position in the transverse direction of the headbox in at least one vertically oriented group, and displacing said at least one vertically oriented group such that all of said additional-flow pipes in said at least one group are displaced jointly.

7. The method of claim 1, further comprising the steps of:

grouping said additional-flow pipes in the same position in a vertical direction of the headbox in at least one group, and displacing each said at least one groups independently.

8. The method of claim 1, further comprising the steps of:

grouping said additional-flow pipes in the same location in the transverse direction of the headbox in vertically oriented groups, and displacing each of said groups by means of a respective actuator such that all of said additional-flow pipes in said group are displaced jointly.

9. A device for regulating a total pulp flow discharged from a headbox to form a web, said total headbox pulp flow being formed from a first component flow and a second component flow, comprising additional-flow pipes for being arranged in a transverse direction of said first component flow for carrying subflows of said second component flow, said second component flow having a different concentration than an average concentration of said first component flow, a turbulence generator having turbulence tubes for coupling to an outlet of said headbox, each of said second component subflows being carried through a respective one of said additional-flow pipes and out of a discharge end thereof aligned with an inlet opening of a respective one of said turbulence tubes, means for passing said first component flow into said inlet openings of said turbulence tubes, displacement means coupled to said additional-flow pipes for displacing the discharge end of each of said additional-flow pipes relative to the inlet opening of a respective one of said turbulence tubes aligned therewith to adjust rates of flow of said second component subflows into said turbulence tubes relative to a rate of flow of said first component flow into said turbulence tubes, and regulation means arranged in connection with said additional-flow pipes for regulating the amount of said second component subflows being carried through said additional-flow pipes.

10. The device of claim 9, wherein said displacement means comprise an actuator.

11. The device of claim 9, wherein said additional-flow pipes are assembled into groups, said displacement means comprising an individual actuator for each of said groups.

12. The device of claim 9, wherein at least one of said turbulence tubes comprises an inlet opening having a conical widening, at least one of said additional-flow pipes having an end insertable into said conical widening.

13. The device of claim 9, further comprising means defining an intermediate chamber for holding a medium forming said first component flow to be passed into said turbulence tubes, means defining a distribution chamber for holding a medium forming said second component subflows, and a partition wall common to both said distribution chamber and said intermediate chamber such that said distribution chamber is formed directly in connection with said intermediate chamber.

14. The device of claim 9, further comprising means defining an intermediate chamber for holding a medium forming said first component flow to be passed into said turbulence tubes, means defining a distribution chamber for holding a medium forming said second component subflows, means for passing the medium forming said second component subflows from said distribution chamber into said additional-flow pipes, and a wall separating said distribution chamber and said intermediate chamber, said additional-flow pipes passing from said intermediate chamber through said wall into connection with said distribution chamber and through said distribution chamber to be coupled to said displacement means.

15. The device of claim 9, wherein said regulation means comprise a displaceable bushing arranged around each of said additional-flow pipes, and an opening arranged in a mantle face of each of said additional-flow pipes, each of said bushings being displaceable into different covering positions of a respective one of said openings by regulating the relative position of each of said brushing to a respective one of said additional-flow pipes.

16. The device of claim 15, further comprising means defining a chamber in which a medium forming said second component subflows is contained, said openings being openable into said chamber, said chamber having an end wall, and a threaded joint arranged between each if said bushings and said end wall of said chamber.

17. The device of claim 15, further comprising a glide fitting arranged between each of said bushings and a respective one of said additional-flow pipes.

18. The device of claim 15, wherein each of said bushings has an outer face, further comprising means defining a chamber in which a medium forming said second component subflows is contained, said inserted being openable into said chamber and defining throttle means with each of said bushings to regulate a flow of medium forming said second component subflows into a respective one said additional-flow pipes, said chamber comprising a wall having an aperture therein through which each of said bushings and a respective one of said additional-flow pipes pass, and means for retaining each of said bushings during displacement of a respective one of said additional-flow pipes, said bushing retaining means comprising a press fitting or threaded joint arranged between an outer face of each of said bushings and said aperture in said wall of said chamber, said displacement means comprising an actuator, said actuator displacing said additional-flow pipes to cause an end opening of said additional-flow pipes to be positioned at different distances from a respective one of said turbulence tubes while each of said bushings remains in its position such that when the rate of flow of said second component subflows into said turbulence tubes is reduced, the rate of flow of said first component flow into said turbulence tubes, is increased to a corresponding extent, and vice versa.

19. The device of claim 15, wherein each of said additional-flow pipes is arranged centrally relative to a respective one of said turbulence tubes such that a central axis of said respective turbulence tube and a central axis of each of said additional-flow pipes coincide.

20. A headbox of a paper machine, comprising an inlet header, a discharge duct, a turbulence generator having a plurality of turbulence tubes having inlet opening coupled to said discharge duct, means for passing a first pulp suspension component flow from said inlet header into said inlet openings of said turbulence tubes, means defining a chamber in which a second component flow is retained, said second component flow having a different concentration than an average concentration of said first component flow, additional-flow pipes arranged in a transverse direction of said first component flow for carrying subflows of said second component flow, each of said second component subflows being carried through a respective one of said additional-flow pipes and out of a discharge end thereof aligned with said inlet opening of a respective one of said turbulence tubes, displacement means coupled to said additional-flow pipes for displacing the discharge end of each of said additional-flow pipes relative to said inlet opening of a respective one of said turbulence tubes aligned therewith to adjust rates of flow of said second component subflows into said turbulence tubes relative to a rate of flow of said first component flow into said turbulence tubes, and regulation means arranged in connection with said additional-flow pipes for regulating the amount of said second component subflows being carried through said additional-flow pipes.

* * * * *